US007803018B1

(12) United States Patent
Islam

(10) Patent No.: US 7,803,018 B1
(45) Date of Patent: Sep. 28, 2010

(54) INNER CONDUCTOR END CONTACTING COAXIAL CONNECTOR AND INNER CONDUCTOR ADAPTER KIT

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/401,367

(22) Filed: Mar. 10, 2009

(51) Int. Cl.
*H01R 9/05* (2006.01)

(52) U.S. Cl. ..... 439/583; 439/578

(58) Field of Classification Search ..... 439/578, 439/583, 584
See application file for complete search history.

(56) References Cited

U.S. PATENT DOCUMENTS

| | | | | |
|---|---|---|---|---|
| 3,109,691 | A | 11/1963 | Burkhardt | |
| 4,046,451 | A | 9/1977 | Juds et al. | |
| 5,137,470 | A | 8/1992 | Doles | |
| 5,545,059 | A | 8/1996 | Nelson | |
| 5,595,502 | A | 1/1997 | Allison | |
| 5,722,856 | A | 3/1998 | Fuchs et al. | |
| 5,830,009 | A | 11/1998 | Tettinger | |
| 5,938,474 | A * | 8/1999 | Nelson | 439/583 |
| 6,109,964 | A * | 8/2000 | Kooiman | 439/583 |
| 6,133,532 | A | 10/2000 | Lundback et al. | |
| 6,332,815 | B1 * | 12/2001 | Bruce | 439/862 |
| 6,386,915 | B1 * | 5/2002 | Nelson | 439/584 |
| 6,409,536 | B1 | 6/2002 | Kanda et al. | |
| 6,840,803 | B2 | 1/2005 | Wlos et al. | |
| 6,893,290 | B2 * | 5/2005 | Buenz et al. | 439/578 |
| 6,926,555 | B2 | 8/2005 | Nelson | |
| 7,374,455 | B2 | 5/2008 | Purdy et al | |
| 7,448,906 | B1 | 11/2008 | Islam | |
| 7,632,143 | B1 * | 12/2009 | Islam | 439/583 |
| 7,690,945 | B2 * | 4/2010 | Petersen | 439/584 |
| 2007/0149047 | A1 | 6/2007 | Wild et al. | |

* cited by examiner

*Primary Examiner*—Thanh-Tam T Le
(74) *Attorney, Agent, or Firm*—Babcock IP, PLLC

(57) ABSTRACT

A coaxial connector is provided with a connector body dimensioned to couple with the outer conductor, an insulator supporting an inner contact coaxial within a bore of the connector body. A spring contact may be positioned to contact an end of the inner conductor. Alternatively, an adapter may be mountable in an adapter bore of the inner contact, the adapter bore open to a cable end of the inner contact. The spring contact mountable within the adapter bore, the spring contact biasing the adapter against an end of the inner conductor.

22 Claims, 13 Drawing Sheets

INNER CONDUCTOR END CONTACTING COAXIAL CONNECTOR AND INNER CONDUCTOR ADAPTER KIT

BACKGROUND OF THE INVENTION

1. Field of the Invention

The invention relates to inner contacts for coaxial cable connectors. More particularly the invention relates to a coaxial connector with an inner contact assembly with a resilient inner conductor end contact configuration that may be reconfigurable for installation upon multiple coaxial cable configurations and/or cable end preparations.

2. Description of Related Art

Coaxial cables of standardized diameter and RF power handling capability may each feature inner conductors of different configurations and/or materials. For example, the inner conductor may be aluminum, copper, copper clad aluminum, and may be solid, hollow, corrugated and/or smooth walled. Further, the inner dimensions of hollow inner conductors may vary significantly, although the inner conductor outer diameter has been standardized.

Coaxial connectors may each be designed for a specific coaxial cable, requiring a manufacturer to design, manufacture and stock a large number of separate coaxial connector models.

Each of the coaxial connector models may also be designed to couple with a specific cable end preparation such as flush cut or protruding inner conductor with specific portions of the insulation between the inner conductor and outer conductor and/or within the hollow inner conductor removed to electrically compensate for impedance discontinuities introduced by the transition between the coaxial cable and the coaxial connector. To prepare these end configurations, an end user may also be required to purchase and maintain a range of different cable/connector combination specific cable end saw guides and insulation coring/striping tools at significant additional expense.

U.S. Pat. No. 5,722,856 discloses an inner contact assembly for a specific hollow inner conductor coaxial cable configuration including a wedge arrangement fixed within the end of the hollow inner conductor by a screw. An inner conductor bellows element crimp connected to the inner contact contacts the end of the wedge arrangement. The inner conductor bellows element provides a longitudinal bias against the wedge arrangement end to absorb potentially degrading effects of cable movement with respect to the connector and/or thermal expansion cycling of the assembly elements. The inner conductor bellows element and numerous individual threaded or otherwise precision machined elements of the inner contact and inner contact assembly may unacceptably increase the connector cost and/or complicate connector manufacture and installation.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
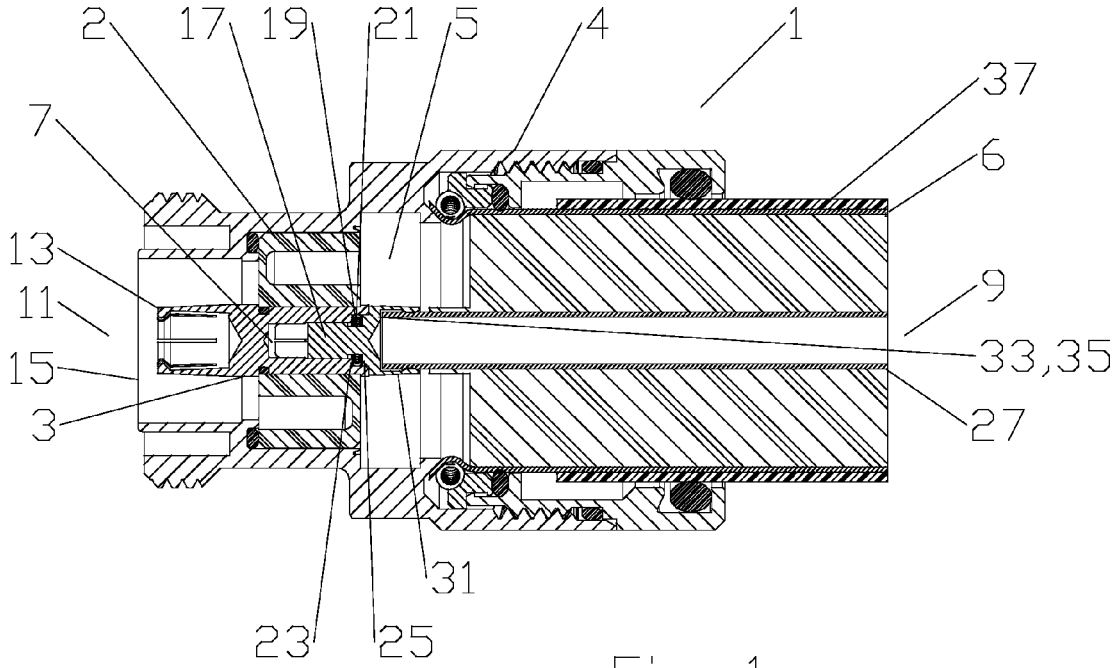
FIG. 1 is a schematic cut-away side view of a first exemplary coaxial connector demonstrated with a protruding inner conductor cable end-prepared coaxial cable attached.
Figure 2:
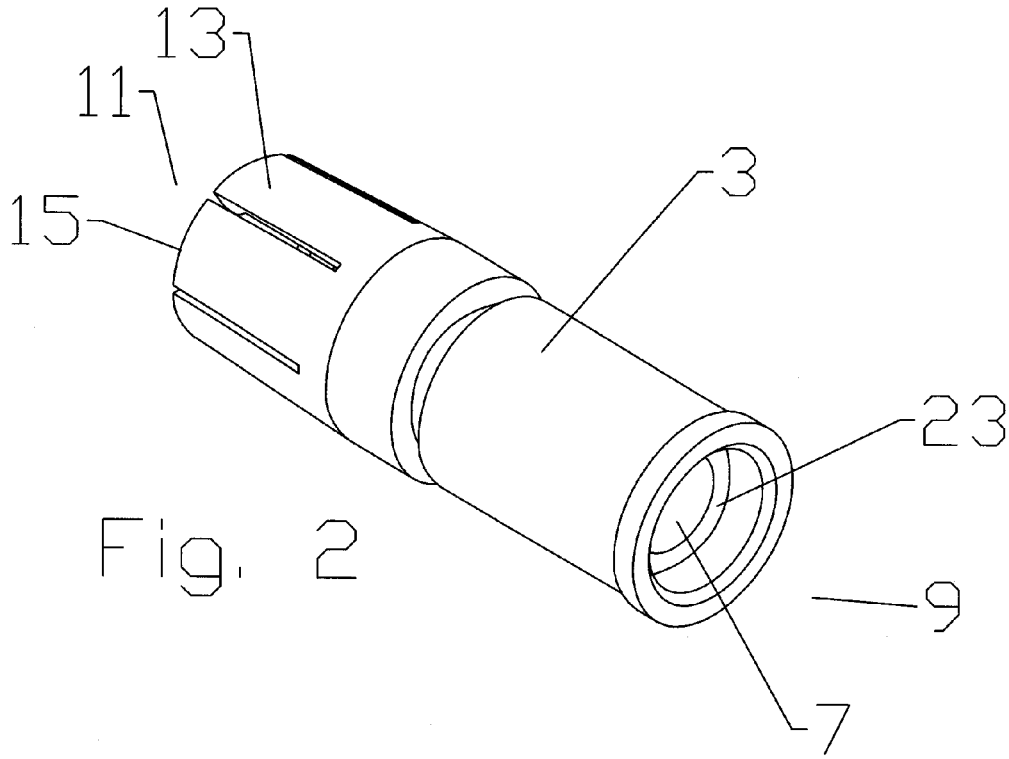
FIG. 2 is a schematic isometric angled cable end view of the inner contact of FIG. 1.
Figure 3:
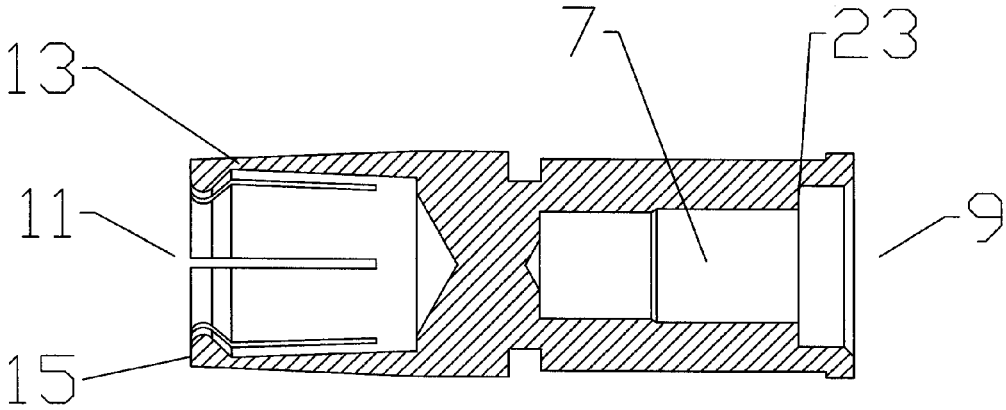
FIG. 3 is a schematic cut-away side view of FIG. 2.

As shown in FIG. 1, a first embodiment of a coaxial cable connector 1 has an inner contact 3 supported by an insulator 2 coaxial within a connector body 4 with a connector body bore 5. The outer conductor 6 is demonstrated coupled with the connector body 4 by leading edge clamping. One skilled in the art will appreciate that the outer conductor 6 to connector body 4 coupling may be alternatively configured according to any desired coupling arrangement, such as interference fit, crimp connection, threading and/or wedge action retention. Best shown in FIGS. 2 and 3, the inner contact 3 has an adapter bore 7 open to a cable end 9 of the inner contact 3. The connector end 11 of the inner contact 3 may be formed for example as a pin or interface spring basket 13 dimensioned according to the selected connector interface 15. The connector interface 15 may be any desired standardized or proprietary connector interface.

One skilled in the art will appreciate that the cable end 9 and the connector end 11 are descriptors used herein to clarify longitudinal locations and contacting interrelationships between the various elements of the coaxial connector 1. In addition to the identified positions in relation to adjacent elements along the coaxial connector 1 longitudinal axis, each individual element has a cable end 9 side and a connector end 11 side, i.e. the sides of the respective element that are facing the respective cable end 9 and the connector end 11 of the coaxial connector 1.

Figure 6:
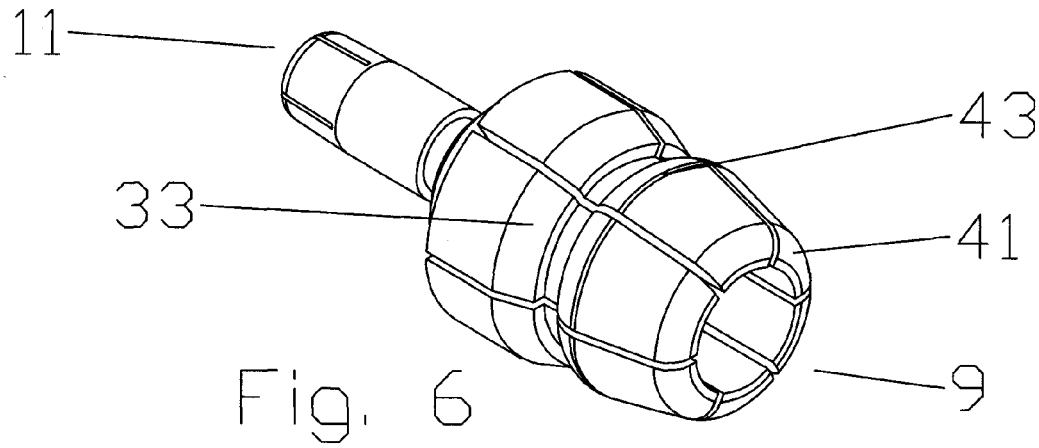
FIG. 6 is a schematic isometric angled view of an alternative adaptor for use with the coaxial connector of FIG. 1.
Figure 7:
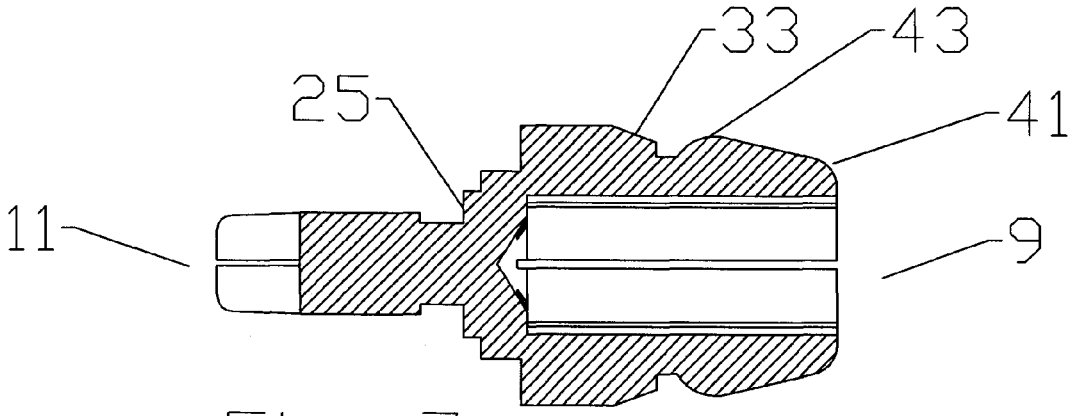
FIG. 7 is a schematic cut-away side view of FIG. 6.
Figure 8:
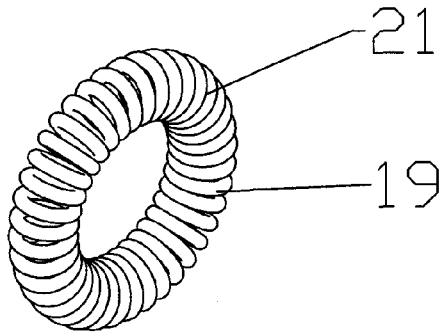
FIG. 8 is a schematic isometric view of the spring contact of FIG. 1.
Figure 9:
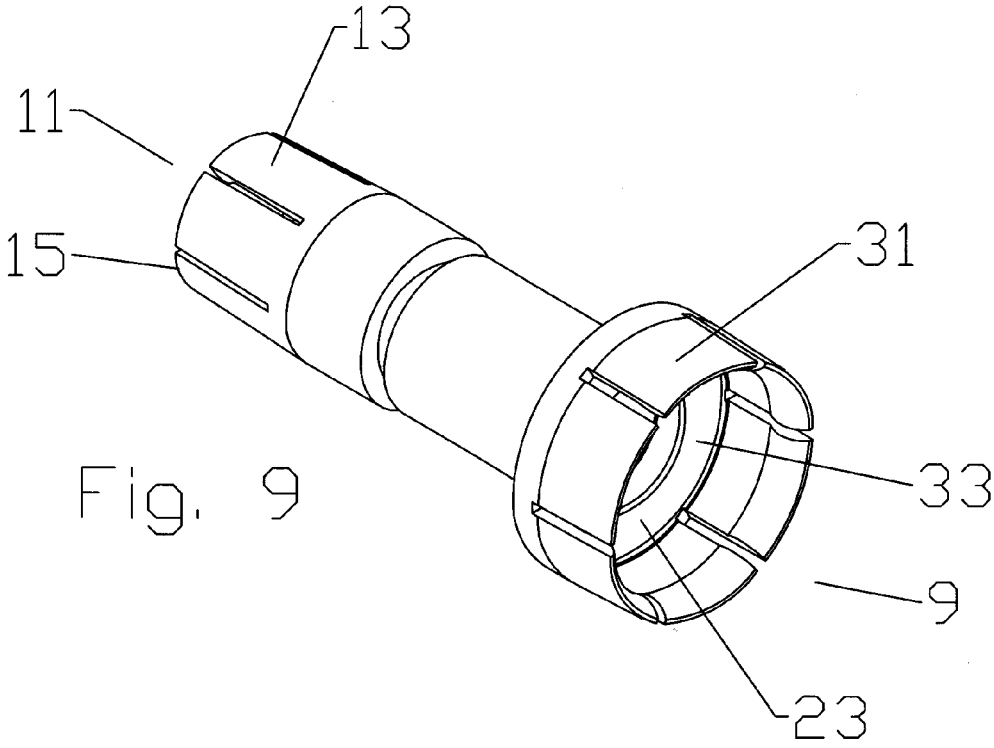
FIG. 9 is a schematic isometric angled cable end view of the inner contact of FIG. 11.
Figure 10:
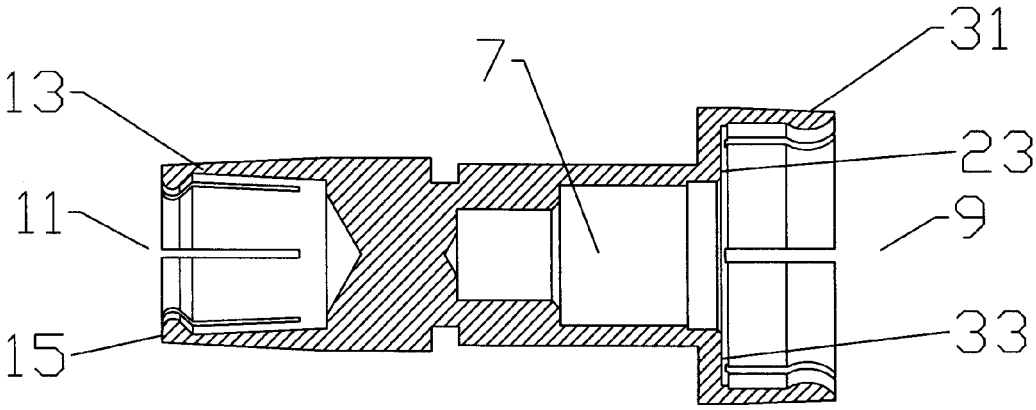
FIG. 10 is a schematic cut-away side view of FIG. 9.

The connector end 11 of a selected adapter 17, for example as shown in FIGS. 4 and 5 or 6 and 7, seats within the adapter bore 7 biased along the coaxial connector 1 longitudinal axis towards the cable end 9 by a spring contact 10, here demonstrated as a circular coil spring 21, for example as shown in FIG. 8. Alternative spring contact(s) 10 include any type of compression spring element, such as belleville washers, wave springs, volute springs, elastic gaskets or the like. The circular coil spring 21 may be seated between an inward projecting shoulder 23 of the adapter bore 7 and an outward projecting shoulder 25 of the adapter 17.

Figure 4:
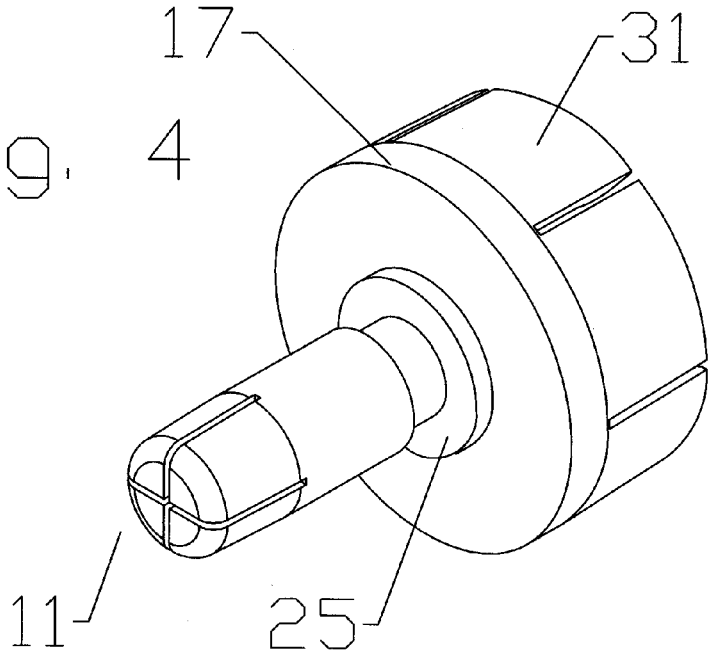
FIG. 4 is a schematic isometric angled connector end view of the adapter of FIG. 1.
Figure 5:
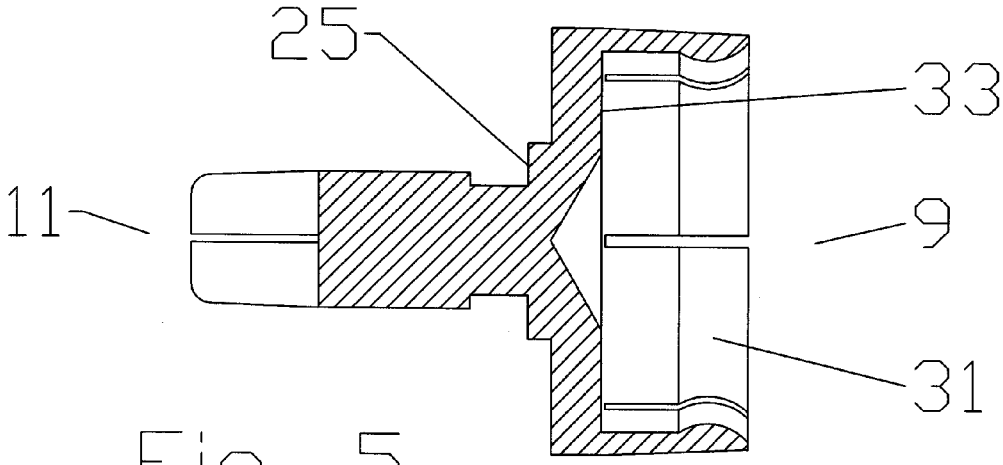
FIG. 5 is a schematic cut-away side view of FIG. 4.

The cable end 9 of the adapter 17 demonstrated in FIGS. 4 and 5 is configured for coupling with the inner conductor 27 of the coaxial cable 29 via a plurality of inward biased spring finger(s) 31 of the adapter 17 dimensioned to bias against the outer diameter of the inner conductor 27. These inward biased spring finger(s) 31 cooperate to extend the adapter bore 7 to the cable end of the adapter 17, that is, to the distal end of the inward biased spring finger(s) 31. The longitudinal axis bias against the inner conductor 27 resulting from the spring contact 10 urges a contact surface 33 of the adapter 17 to seat against the leading edge 35 of the inner conductor 27, providing a circumferential contact that, enhanced by the longitudinal bias, provides a secure electrical interconnection with improved passive intermodulation (PIM) distortion characteristics, compared to a conventional inner contact featuring an inward biased spring finger basket only.

Alternative adapter(s), for example as shown in FIGS. 6 and 7, may be configured for coupling with a hollow inner conductor by insertion into the open end of the hollow inner conductor 27. A plurality of outward biased spring finger(s) 41 projecting from the cable end 9 of the adapter 17 are dimensioned to contact and bias against the inner diameter sidewall. The contact surface 33 of the adapter 17 may be provided as an annular conical area of the adapter 17 extending between a diameter greater than the hollow inner conductor diameter at the connector end of the contact surface to less than the hollow inner conductor diameter at the cable end of the contact surface, angled to wedge against the inner diameter of the leading edge 35.

The conical aspect of the contact surface 33 enables the adapter 17 to provide coupling with the leading edge 35 of an increased range of inner conductor 27 inner diameter(s), for example where a thickness of the hollow inner conductor 27 sidewall is varied according to desired strength characteristics and/or manufacturing variances that may occur between production runs of the same coaxial cable 37 configuration over time and/or between different manufacturers.

Figure 11:
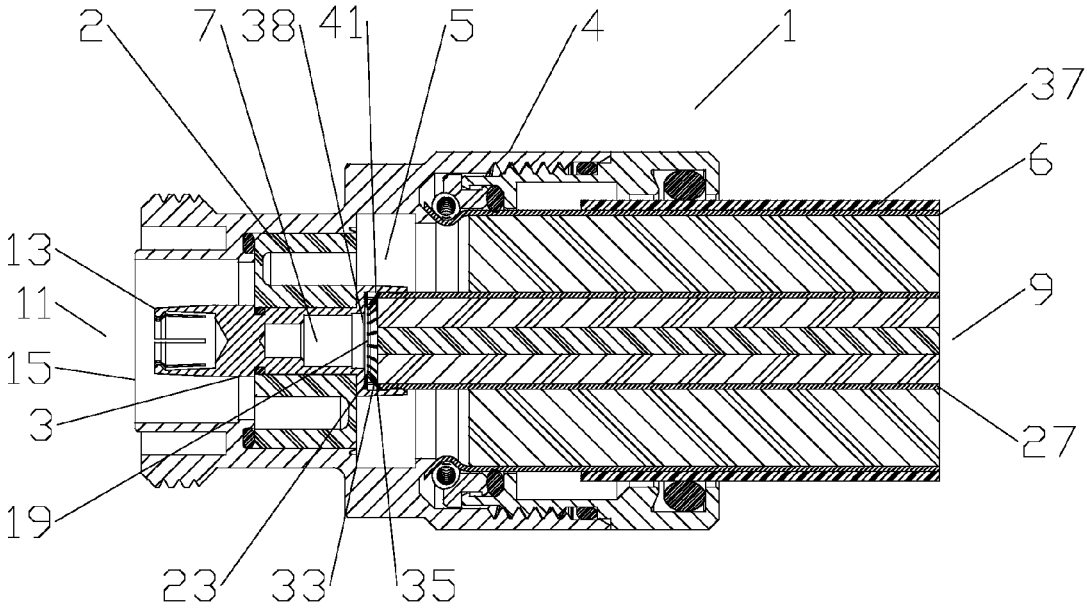
FIG. 11 is a schematic cut-away side view of a second exemplary coaxial connector demonstrated with a protruding inner conductor cable end prepared coaxial cable attached.
Figure 12:
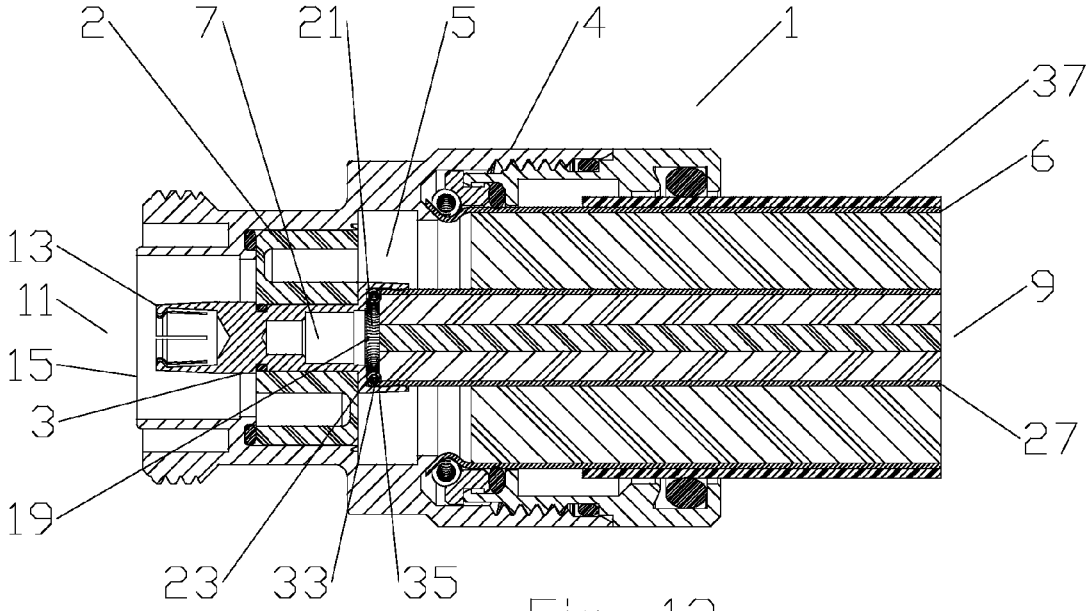
FIG. 12 is a schematic cut-away side view of a second exemplary coaxial connector demonstrated with a circular coil spring as the spring contact and with a protruding inner conductor cable end-prepared coaxial cable attached.
Figure 13:
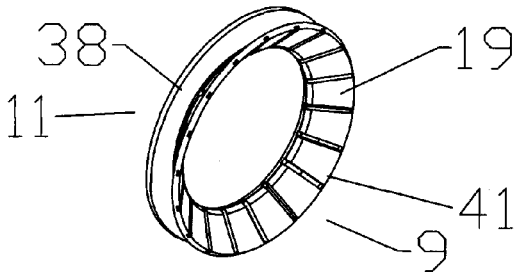
FIG. 13 is a schematic isometric angled cable end view of the spring contact of FIG. 11.
Figure 14:
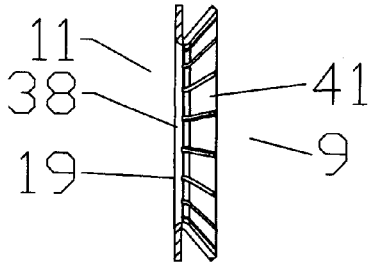
FIG. 14 is a schematic cut-away side view of FIG. 13.

Alternatively, for example as shown in FIGS. 9-12, the inner contact 3 may be formed with a plurality of inward biased spring finger(s) 31 projecting from the cable end 9, dimensioned to bias against the outer diameter of the inner conductor 27 and/or a similarly dimensioned adapter 17 seated within the adapter bore 7. Where the interconnection between the inner contact 3 and the inner conductor 27 is made without use of an adapter 17, for example where the coaxial cable 37 end preparation includes an inner conductor 27 extension from the end of the coaxial cable 37 end far enough to seat within the inward biased spring finger(s) 31 of the inner contact 3, a longitudinally biased circumferential interconnection with the leading edge 35 of the inner conductor 27 may be provided by a spring contact 19 seated in an inward projecting shoulder 23 of the adapter bore 7 proximate the proximal end of the inward biased spring finger(s) 31. The spring contact 19 may be provided as circular coil spring, for example as shown in FIG. 12, or any of the alternative springs, including wherein the spring contact 19 is provided as a contiguous or non-contiguous ring 38, from which a plurality of contact spring finger(s) 39 extend, for example, radially outward together forming the contact surface 33, for example as shown in FIGS. 11 and 13-14. An advantage of this spring contact 19 configuration is that the bias of each of the contact spring finger(s) 39 provides an additional tolerance for uniform circumferential contact with the leading edge 35 of the inner conductor 27; for example, where the leading edge 35 of the inner conductor 27 has not been cut cleanly and/or precisely normal to the longitudinal axis of the inner conductor 27, some of the contact spring finger(s) 39 will be deflected more than others but each will still contact the corresponding circumferential portion of the leading edge 35 of the inner conductor 27.

The adapter 17 and/or multiple alternative adapter(s) 17 supplied in a kit configuration with the coaxial connector 1 may be provided configured to couple with the dimensions of a wide range of different inner conductor(s) 27, in addition to those inner conductor(s) 27 that may be coupled without applying the adapter 17, such as smooth sidewall inner conductors that are solid and/or provided with supporting core elements and/or other filler within a hollow inner conductor 27, as shown for example in FIGS. 11 and 12.

Figure 15:
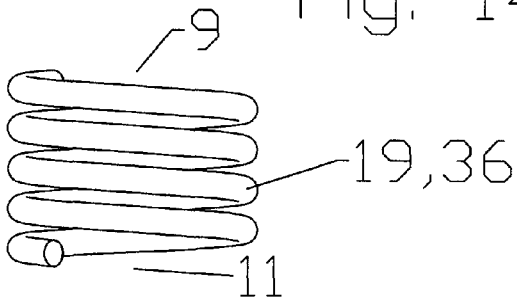
FIG. 15 is a schematic side view of the secondary spring of FIG. 18.
Figure 16:
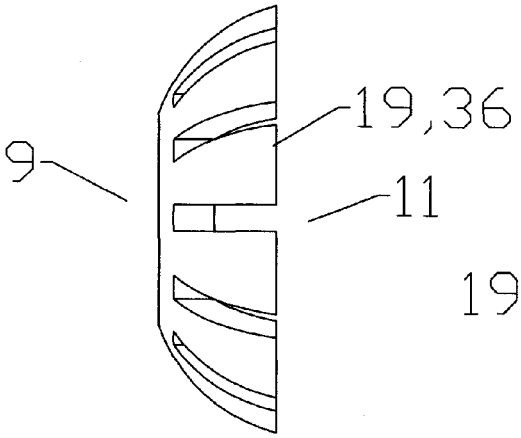
FIG. 16 is a schematic side view of the secondary spring of FIG. 19.
Figure 17:
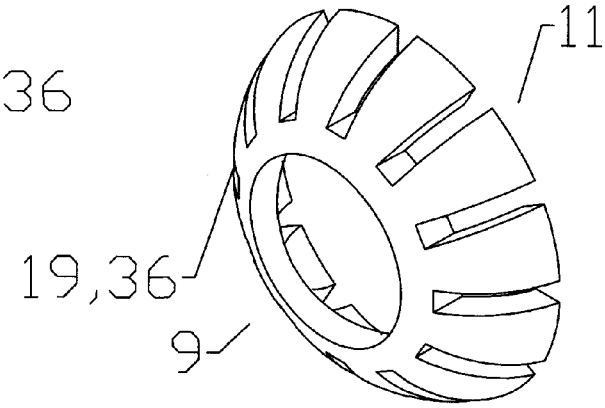
FIG. 17 is a schematic angled isometric view of FIG. 16.
Figure 18:
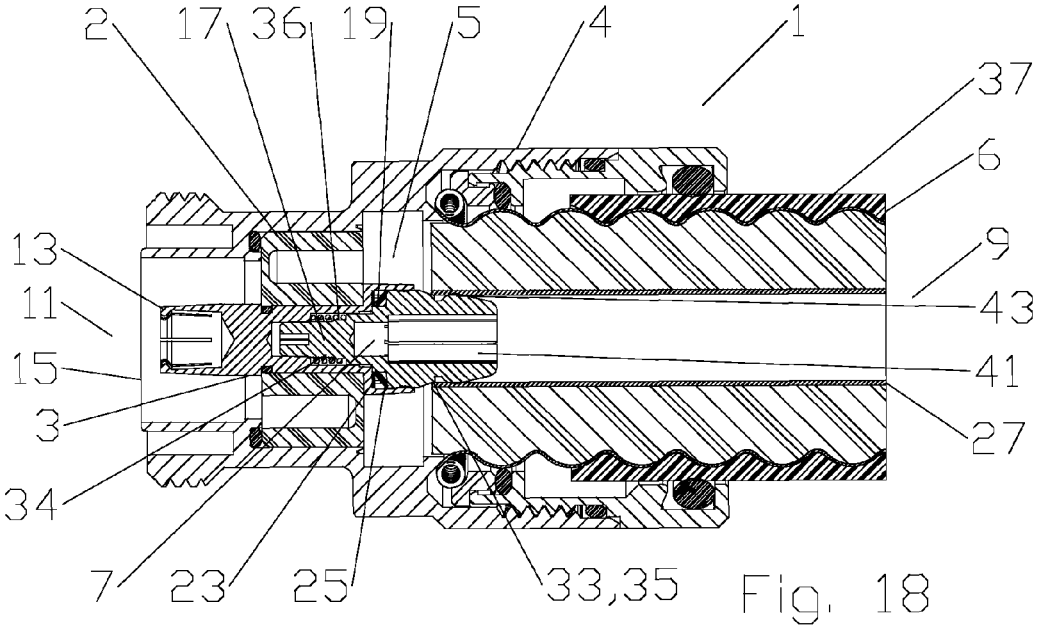
FIG. 18 is a schematic cut-away side view of a third exemplary coaxial connector demonstrated with a flush inner conductor cable end-prepared coaxial cable attached.
Figure 19:
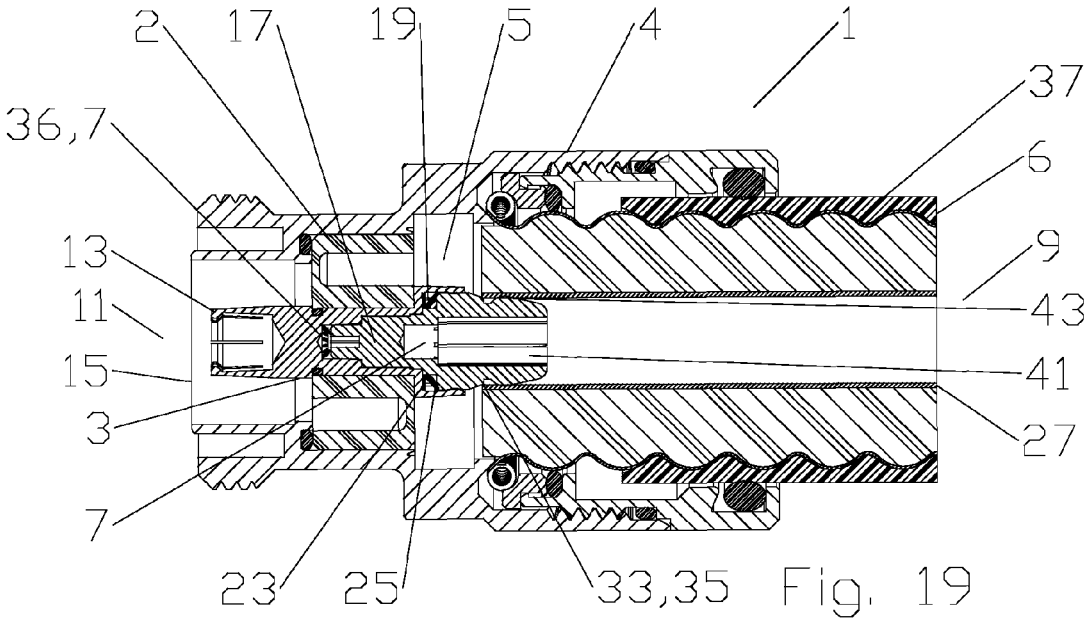
FIG. 19 is a schematic cut-away side view of FIG. 19, with an alternative secondary spring configuration.
Figure 20:
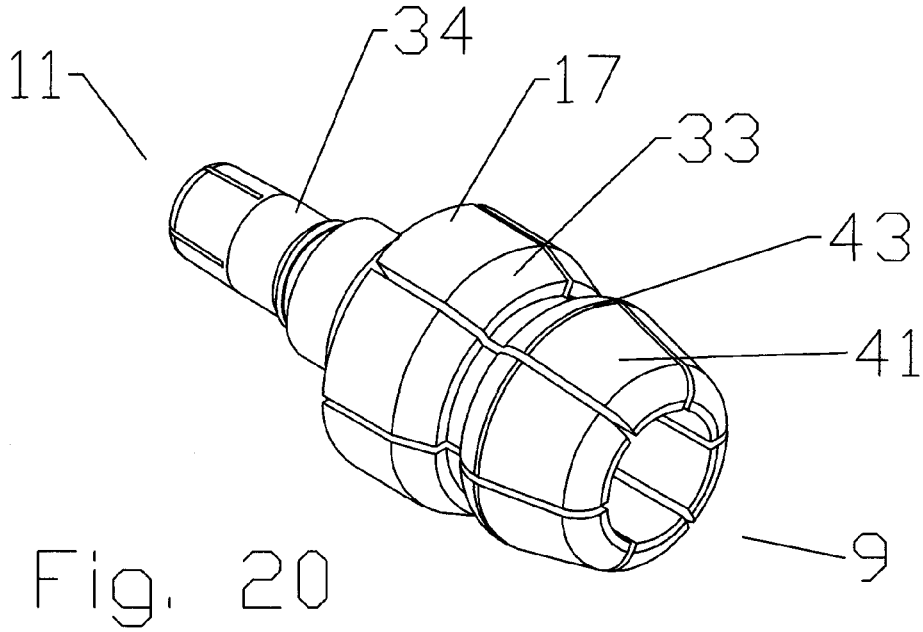
FIG. 20 is a schematic isometric angled cable end view of the adapter of FIG. 19.
Figure 21:
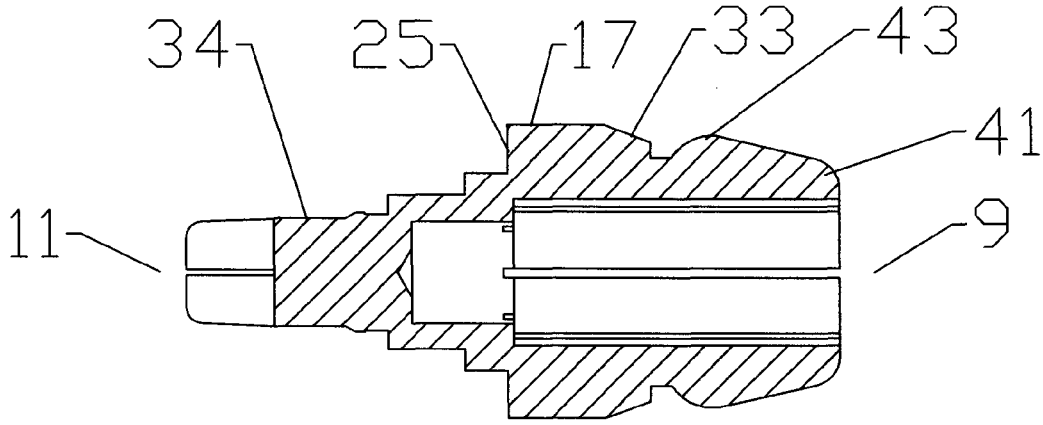
FIG. 21 is a schematic cut-away side view of FIG. 20.
Figure 22:
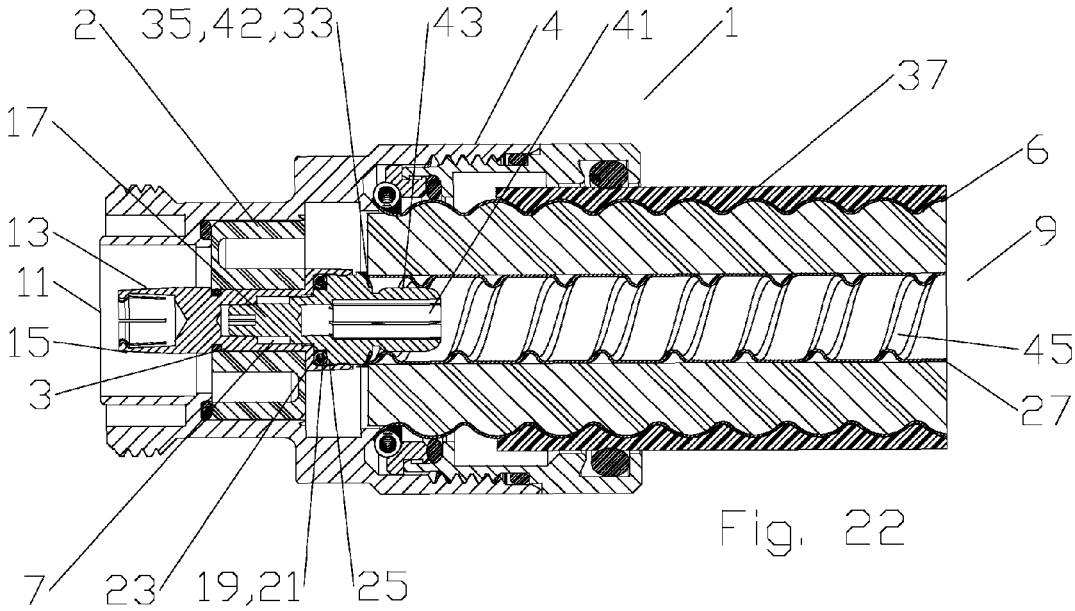
FIG. 22 is a schematic cut-away side view of a fourth exemplary coaxial connector demonstrated with a flush inner conductor cable end prepared coaxial cable attached.

The bias of the adapter 17 towards the cable end 9 provided by the spring contact 19 may be enhanced by applying one or more secondary spring(s) 36. The secondary spring 36 may be may be positioned, for example as shown in FIG. 19, at the bottom of the adapter bore 7 acting upon the connector end 11 of the adapter 17. Here the secondary spring 36 is demonstrated as a Belleville washer with a slotted periphery as shown for example in FIGS. 16 and 17. Alternatively, the secondary spring 36 may be provided with a longitudinal axis coaxial with the adapter, for example applied as a helical spring seated around a spring seat surface 34 (FIGS. 15 and 18) of the outer diameter of the adapter 17 as shown for example in FIGS. 16 and 19. These secondary spring 36 arrangements may also be applied as alternative spring contact 19 configurations.

Figure 23:
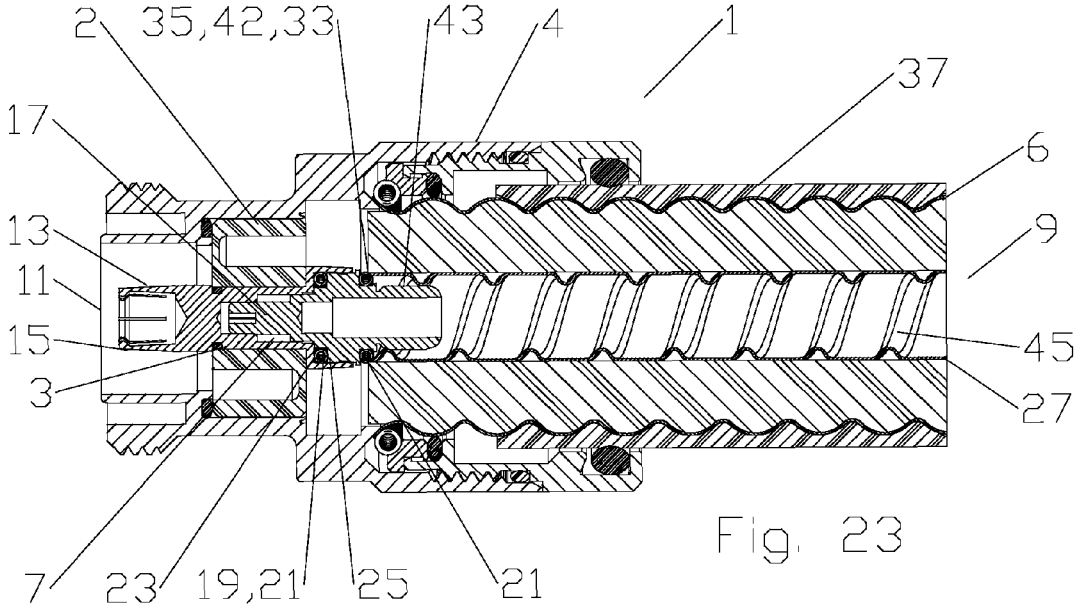
FIG. 23 is a schematic cut-away side view of FIG. 22, with an alternative adapter and contact spring surface contact configuration.
Figure 24:
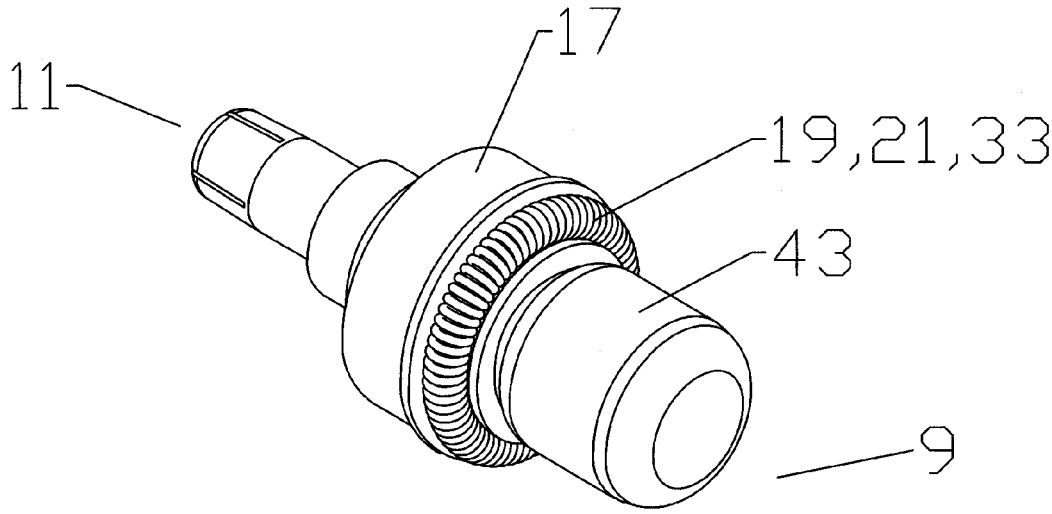
FIG. 24 is a schematic isometric angled cable end view of the adapter and contact spring surface contact of FIG. 23.
Figure 25:
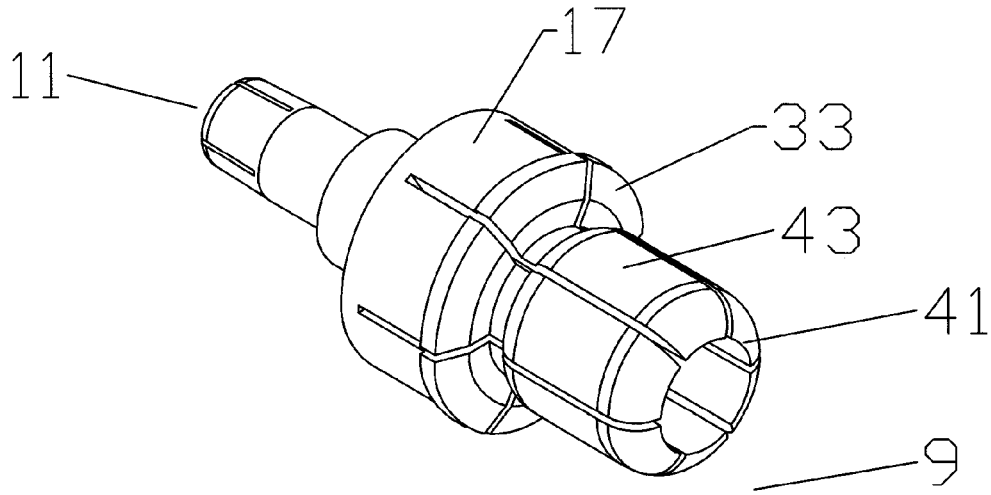
FIG. 25 is a schematic isometric angled cable end view of the adapter of FIG. 22.
Figure 26:
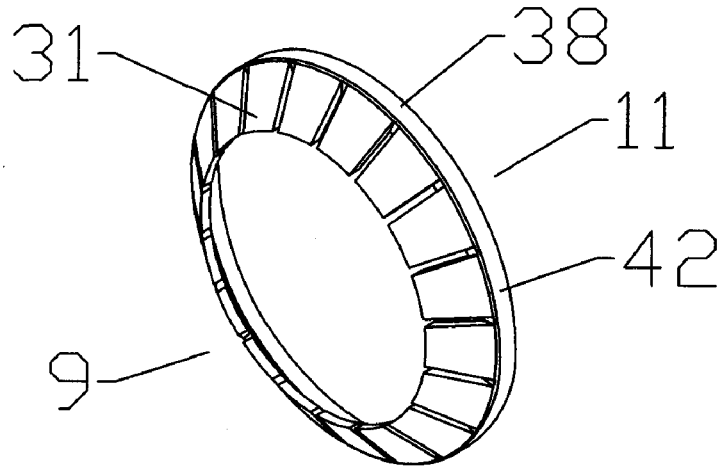
FIG. 26 is a schematic isometric angled cable end view of the contact surface spring contact of FIG. 22.
Figure 27:
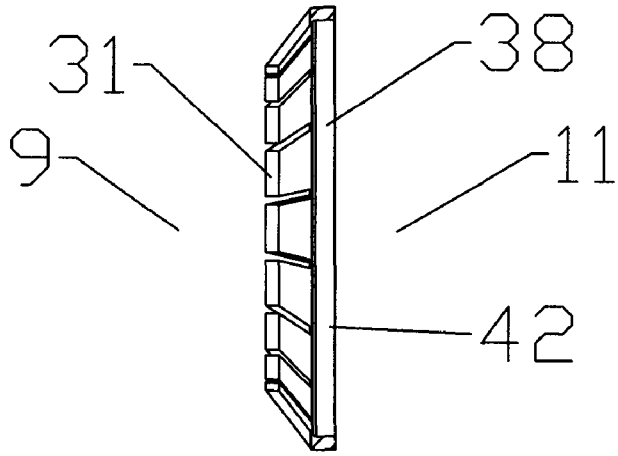
FIG. 27 is a schematic cut-away side view of FIG. 26.

As shown for example in FIGS. 23 and 24, non-uniform leading edge 35 contacting functionality may also be added proximate the contact surface 33 of the adapter 17 via a contact surface spring contact 42, such as a circular coil spring 21. Alternatively, as shown for example in FIG. 23, the contact surface spring contact 42 may be applied as a variation of the ring 38 with spring fingers, here extending radially inward as shown in FIGS. 26 and 27, seated proximate the contact surface 33. Also in the present embodiment(s), an engagement surface 43 of either a plug end or outward biased spring finger(s) 41 of the adapter 17 is demonstrated extended longitudinally, as best shown in FIGS. 24 and 25, to enable the adapter 17 to couple with an extended length of the inner diameter of the hollow inner conductor 27 provided with a helical corrugation 54. Thereby, a circumferential contact against at least one half of a helical corrugation 45 loop around the inner diameter of the hollow inner conductor 27 may be obtained.

Figure 28:
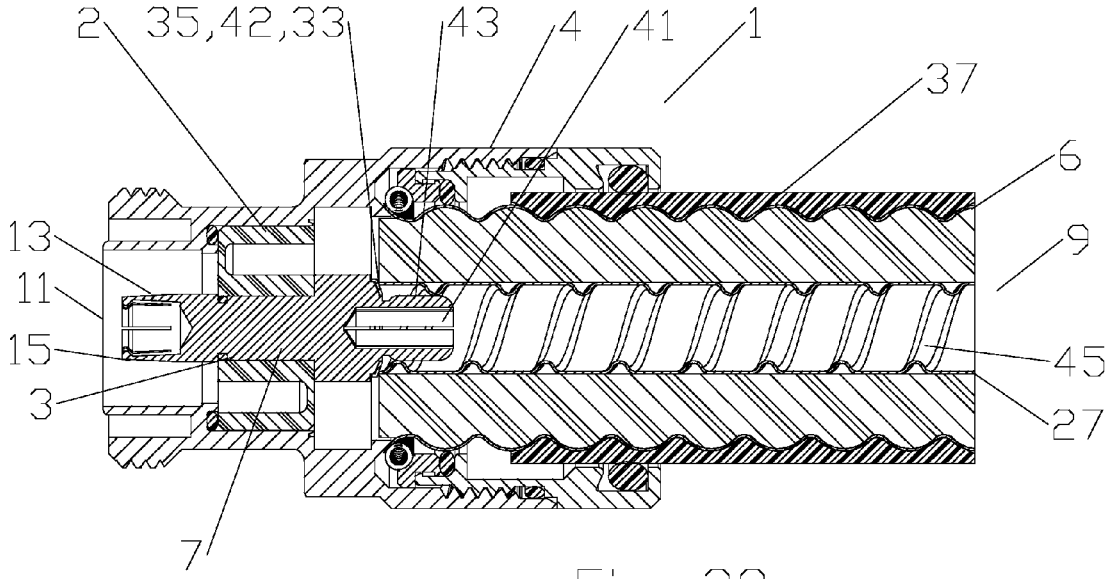
FIG. 28 is a schematic cut-away side view of a fifth exemplary coaxial connector demonstrated with a flush inner conductor cable end prepared coaxial cable attached.
Figure 29:
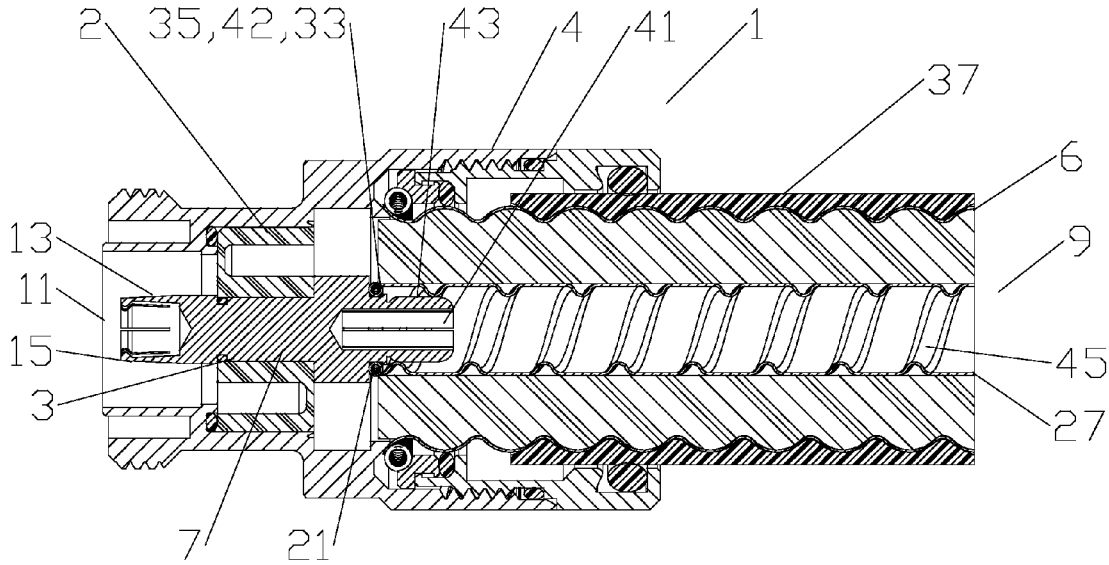
FIG. 29 is a schematic cut-away side view of a fifth exemplary coaxial connector demonstrated with a circular coil spring as the spring contact and with a flush inner conductor cable end-prepared coaxial cable attached.

In further embodiment(s), for example as shown in FIGS. 28 and 29, the non-uniform leading edge 35 resilient circumferential contacting functionality may also be applied as described herein above with respect to an inner contact 3 provided with outward biased spring finger(s) 41 extending from the cable end 9 of the inner contact 3, the outward biased spring finger(s) 41 dimensioned to bias against the inner diameter of a hollow inner conductor 27.

One skilled in the art will appreciate several potential benefits of easily configurable and exchangeable inner contact 3 arrangements. By providing a range of available inner contact 3 arrangements, the number of unique coaxial cable 1 configurations that may be required to satisfy existing coaxial cable 37 dimensions and/or end preparations may be significantly reduced. The longitudinal biased leading edge 35 coupling provided by these configurations may provide improved electrical coupling between the inner contact 3 and the inner conductor 27 that may be resistant to degradation due to vibration and/or thermal expansion cycling of coaxial cable 37 and/or the installed coaxial connector 1, without the expense of an inner conductor bellows. By enabling compatibility with both flush cut and protruding inner conductor 27 cable end configurations, the exchangeable inner contact 3 arrangements may allow the user to install the coaxial connector 3 with whichever cable end preparation tool the user may have available at the time of installation.

The inner contact 3 arrangement(s) may be easily integrated with existing coaxial connector 1 configurations with a minimum of engineering rework and/or tooling modification. Depending, for example, upon the desired operating frequencies, the required modifications may be limited to the exchange of a conventional inner contact configuration with an inner contact 3 arrangement as described herein, enabling the replacement of multiple existing cable specific coaxial connector 1 models with a single coaxial connector 1 model.

| Table of Parts | |
|---|---|
| 1 | coaxial cable connector |
| 2 | insulator |
| 3 | inner contact |
| 4 | connector body |
| 5 | connector body bore |
| 7 | adapter bore |
| 9 | cable end |

-continued

| Table of Parts | |
|---|---|
| 11 | connector end |
| 13 | interface spring basket |
| 15 | connector interface |
| 17 | adapter |
| 19 | spring contact |
| 21 | circular coil spring |
| 23 | inward projecting shoulder |
| 25 | outward projecting shoulder |
| 27 | inner conductor |
| 31 | inward biased spring finger |
| 33 | contact surface |
| 34 | spring seat surface |
| 35 | leading edge |
| 36 | secondary spring |
| 37 | coaxial cable |
| 38 | ring |
| 39 | contact spring finger |
| 41 | outward biased spring finger |
| 42 | contact surface spring contact |
| 43 | engagement surface |
| 45 | helical corrugation |

Where in the foregoing description reference has been made to ratios, integers or components having known equivalents then such equivalents are herein incorporated as if individually set fourth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coaxial connector for a coaxial cable having an inner conductor and an outer conductor, the coaxial connector comprising:

a connector body dimensioned to couple with the outer conductor;

an insulator supporting an inner contact coaxial within a bore of the connector body;

an adapter bore of the inner contact, the adapter bore open to a cable end of the inner contact;

an adapter seatable within the adapter bore; and a spring contact mountable within the adapter bore, the spring contact biasing the adapter against an end of the inner conductor.

2. The connector of claim 1, further including a plurality of inward biased spring fingers at a cable end of the inner contact.

3. The connector of claim 1, further including a plurality of inward biased spring fingers at a cable end of the adapter.

4. The connector of claim 1, wherein the adapter is provided with an annular contact surface extending between a diameter greater than a hollow inner conductor diameter at the connector end of the contact surface and less than the hollow inner conductor diameter at the cable end of the contact surface.

5. The connector of claim 4, further including a contact surface spring contact seated between the contact surface and the inner conductor.

6. The connector of claim 5, wherein the contact surface spring contact is a plurality of radial inward spring fingers extending from a base ring.

7. The connector of claim 5, wherein the contact surface spring contact is a circular coil spring.

8. The connector of claim 1, wherein the spring contact has a longitudinal axis coaxial with the adapter.

9. The connector of claim 1, wherein the spring contact is helical along a longitudinal axis of the adapter.

10. The connector of claim 1, wherein the spring contact is a circular coil spring.

11. The connector of claim 1, wherein the spring contact is a Belleville washer.

12. The connector of claim 1, wherein the spring contact has a plurality of radial outward spring fingers extending from a ring.

13. The connector of claim 1, wherein the spring contact is seated between a bottom of the adapter bore and a connector end of the adapter.

14. The connector of claim 1, wherein the spring contact is seated between an inward shoulder of the adapter bore and an outward shoulder of the adapter.

15. The connector of claim 1, further including a plurality of outward biased spring fingers at a cable end of the adapter.

16. The connector of claim 15, wherein an engagement surface along an outer diameter of the outward biased spring fingers has a longitudinal extent equal to or greater than a length of the inner conductor along which a helical corrugation of the inner conductor extends around a circumference of the inner conductor.

17. A coaxial connector for a coaxial cable having an inner conductor and an outer conductor, the coaxial connector comprising:

a connector body dimensioned to couple with the outer conductor;

an insulator supporting an inner contact coaxial within a bore of the connector body;

a plurality of inward biased spring fingers at a cable end of the inner contact;

an adapter bore of the inner contact, the adapter bore open to a cable end of the inner contact;

an adapter seatable within the adapter bore;

the adapter provided with an annular contact surface extending between a diameter greater than a hollow inner conductor diameter at the connector end of the contact surface and less than the hollow inner conductor diameter at the cable end of the contact surface; and a spring contact mountable within the adapter bore, the spring contact biasing the adapter against an end of the inner conductor.

18. A coaxial connector kit connectable with coaxial cable (s) having an inner conductor and an outer conductor, the coaxial connector kit comprising:

a connector body dimensioned to couple with the outer conductor;

an insulator supporting an inner contact coaxial within a bore of the connector body;

an adapter bore of the inner contact, the adapter bore open to a cable end of the inner contact;

a plurality of adapters, each adapter separately seatable within the adapter bore; and a spring contact mountable within the adapter bore, the spring contact biasing the adapter against an end of the inner conductor.

19. The kit of claim 16, wherein at least one of the adapters has a plurality of outward biased spring fingers at a cable end of the adapter.

20. The kit of claim 16, wherein at least one of the adapters has an engagement surface along an outer diameter of a cable end of the adapter; a longitudinal extent of the engagement surface equal to or greater than a length of the inner conductor along which a helical corrugation of the inner conductor extends around at least one half a circumference of the inner conductor.

21. The kit of claim 16, wherein at least one of the adapter (s) is provided with a contact surface spring contact seated between the contact surface and the end of the inner conductor.

22. The kit of claim 16, wherein at least one of the adapter (s) is provided with an annular contact surface extending between a diameter greater than a hollow inner conductor diameter at the connector end of the contact surface and less than the hollow inner conductor diameter at the cable end of the contact surface.

* * * * *